US010395631B1

(12) United States Patent
Boxberger

(10) Patent No.: US 10,395,631 B1
(45) Date of Patent: Aug. 27, 2019

(54) MAGNETIC PEDALBOARD SYSTEM TO GENERATE SOUND EFFECTS FOR MUSICAL INSTRUMENTS

(71) Applicant: Frank Dale Boxberger, Scottsdale, AZ (US)

(72) Inventor: Frank Dale Boxberger, Scottsdale, AZ (US)

( * ) Notice: Subject to any disclaimer, the term of this patent is extended or adjusted under 35 U.S.C. 154(b) by 0 days.

(21) Appl. No.: 16/208,340

(22) Filed: Dec. 3, 2018

Related U.S. Application Data

(60) Provisional application No. 62/594,190, filed on Dec. 4, 2017.

(51) Int. Cl.
*G10H 1/02* (2006.01)
*G10H 1/34* (2006.01)

(52) U.S. Cl.
CPC ..... *G10H 1/348* (2013.01); *G10H 2220/275* (2013.01)

(58) Field of Classification Search
CPC ..... G06F 2203/04105; G06F 3/0334; G10H 1/348; G10H 1/34; G10H 2210/155; G10H 2220/071; G10H 2210/195; G10H 2220/561; G10D 13/006; G10D 13/00
See application file for complete search history.

(56) References Cited

U.S. PATENT DOCUMENTS 5,166,467 A * 11/1992 Brown ..... G10H 1/348 84/715
10,192,536 B1 * 1/2019 Jia ..... G10H 1/0008
2007/0295190 A1 * 12/2007 Collins ..... G10H 1/32 84/422.1
2013/0055879 A1 * 3/2013 Clark ..... G10H 1/0091 84/737
2013/0298752 A1 * 11/2013 Juszkiewicz ..... G10H 1/34 84/746
2015/0161978 A1 * 6/2015 Packouz ..... G10H 1/40 84/746
2015/0371622 A1 * 12/2015 Beaty ..... G10H 1/46 84/633

* cited by examiner

*Primary Examiner* — Marlon T Fletcher
(74) *Attorney, Agent, or Firm* — Plager Schack LLP; Mark H. Plager; Eric Liou

(57) ABSTRACT

A magnetic pedalboard system to supply power to effects pedals for use with a musical instrument is provided. The magnetic pedalboard system includes a base member, a pair of conductive strips coupled to the top surface of the base member and electrically coupled to a power supply, and at least one pedal coupled to the pair of conductive strips, the at least one pedal having a first portion of magnetic electrical contacts electrically coupled to a second portion of magnetic electrical contacts. The at least one pedal is designed to slide along any portion of the conductive strips with the first portion of magnetic electrical contacts directly coupled to the first conductive strip and the second portion of magnetic electrical contacts directly coupled to the second conductive strip, thereby permitting the power supply to transmit electricity through the conductive strips to the at least one pedal.

10 Claims, 7 Drawing Sheets

MAGNETIC PEDALBOARD SYSTEM TO GENERATE SOUND EFFECTS FOR MUSICAL INSTRUMENTS

RELATED APPLICATION

The application claims priority to provisional patent application U.S. Ser. No. 62/594,190 filed on Dec. 4, 2017, the entire contents of which is herein incorporated by reference.

BACKGROUND

The embodiments herein relate generally to pedalboards for musical instruments. More specifically, embodiments of the invention relate to a magnetic pedalboard system for use with pedals to generate effects for musical instruments.

Pedalboards are commonly used by musicians to create certain sound effects associated with an electric musical instrument such as a guitar or bass guitar during a performance. Current pedalboard systems comprise a flat board configured to receive a plurality of effects pedals to alter and enhance the sound generated by the instrument. The effects pedals are generally coupled to the flat board by mechanical fasteners such as hook and loop fasteners. In many instances, each of these pedalboard systems comprises a power source operably connected to the flat board and electrically coupled to the plurality of pedals by wires.

These pedalboard systems have numerous disadvantages. In particular, the hook and loop fasteners make it difficult for users to remove and/or move the pedals from one location to another on the flat board. In addition, conventional pedalboard systems do not effectively address the power requirements of the pedals. Since separate wires have to be connected to each and every pedal and the power source, setup time of the pedalboard system and confusion on behalf of the user is common due to the frequent entanglement of the wires.

As such, there is a need in the industry for a magnetic pedalboard system for use with musical instruments that addresses the limitations of the prior art, which provides power to each pedal without the use of wires and permits the user to easily maneuver each pedal to different locations on the pedalboard.

SUMMARY

In one embodiment of the invention, a magnetic pedalboard system configured to supply power to a plurality of effects pedals for use in conjunction with a musical instrument to generate sound effects is provided. The magnetic pedalboard system comprises a base member comprising a top surface and a bottom surface, a pair of conductive strips coupled to the top surface of the base member and electrically coupled to a power supply, the first conductive strip in the pair of conductive strips being positively charged and the second conductive strip in the pair of conductive strips being negatively charged, and at least one pedal coupled to the pair of conductive strips, the at least one pedal comprising a plurality of magnetic electrical contacts, the plurality of magnetic electrical contacts comprising a first portion of magnetic electrical contacts electrically coupled to a second portion of magnetic electrical contacts, wherein the at least one pedal is configured to slide along any portion of the pair of conductive strips with the first portion of magnetic electrical contacts directly coupled to the first conductive strip and the second portion of magnetic electrical contacts directly coupled to the second conductive strip, thereby permitting the power supply to transmit electricity through the pair of conductive strips to the at least one pedal.

In an alternative embodiment of the invention, the magnetic pedalboard system comprises a base member comprising a top surface and a bottom surface, a pair of conductive strips coupled to the top surface of the base member and electrically coupled to a power supply, an adapter base coupled to the pair of conductive strips and comprising a plurality of magnetic electrical contacts, the plurality of magnetic electrical contacts comprising a first portion of magnetic electrical contacts electrically coupled to a second portion of magnetic electrical contacts, and at least one pedal coupled to the adapter base and electrically coupled to the plurality of magnetic electrical contacts of the adapter base, wherein the adapter base is configured to slide along any portion of the pair of conductive strips with the first portion of magnetic electrical contacts directly coupled to the first conductive strip and the second portion of magnetic electrical contacts directly coupled to the second conductive strip, thereby permitting the power supply to transmit electricity through the pair of conductive strips and adapter base to the at least one pedal.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
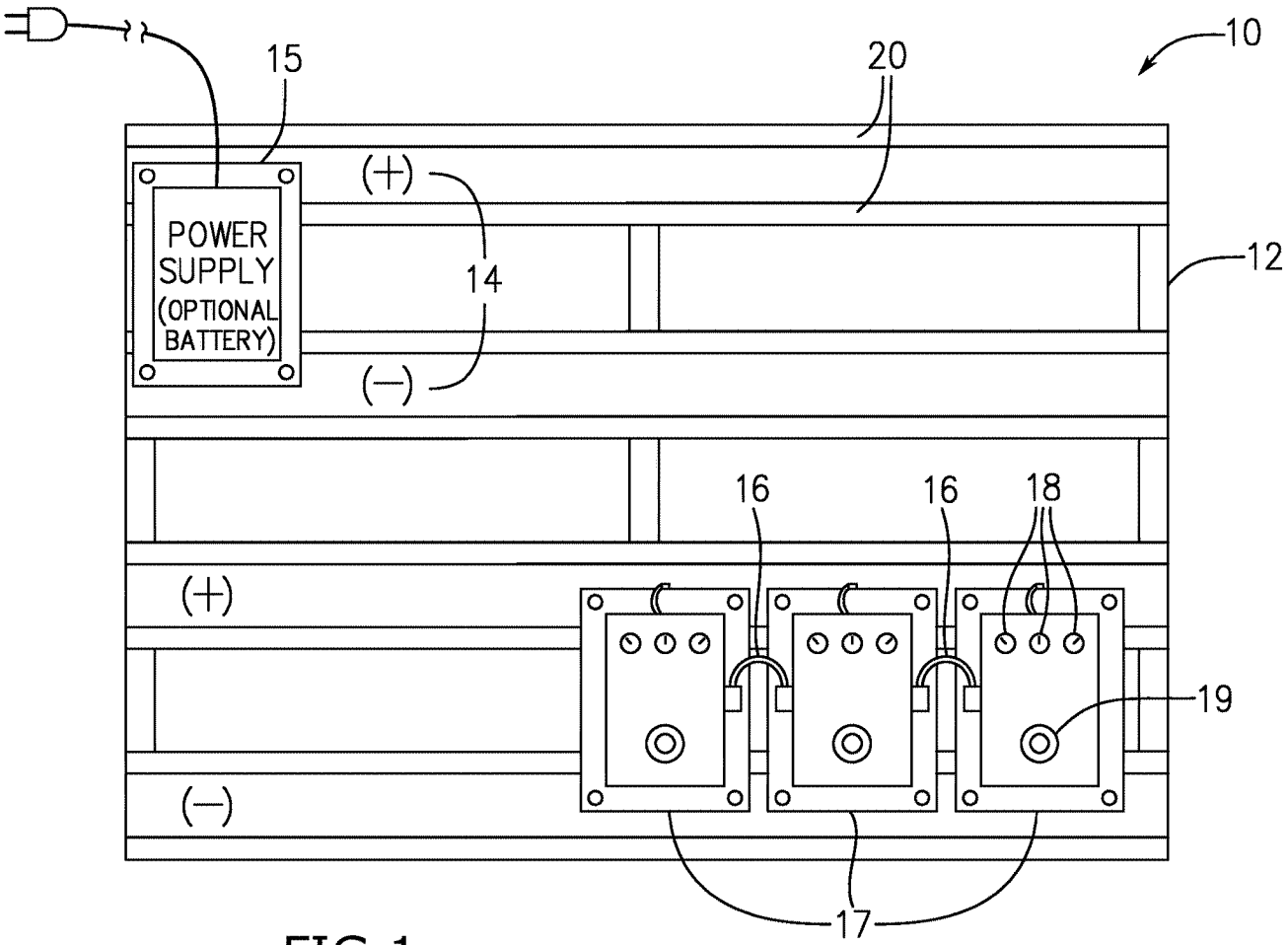
FIG. 1 depicts a top plan view of certain embodiments of the magnetic pedalboard system shown in use.
Figure 2A:
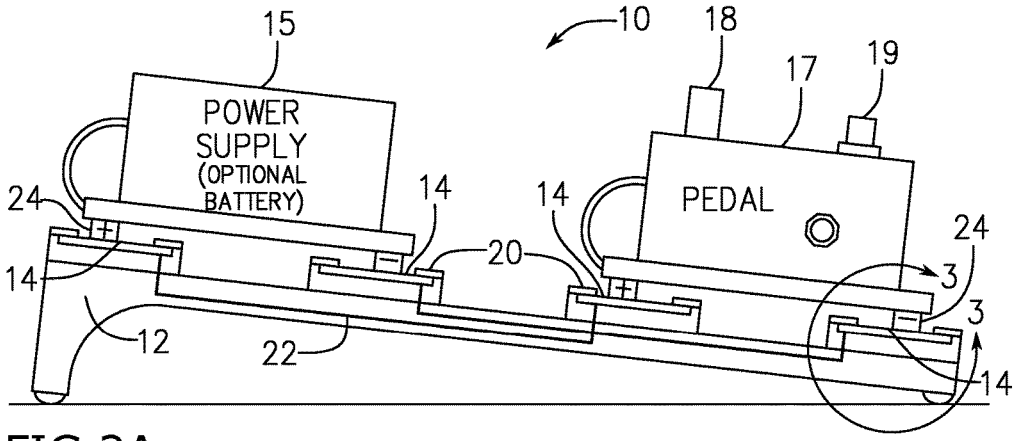
FIG. 2A depicts a side elevation view of certain embodiments of the magnetic pedalboard system shown in use.
Figure 2B:
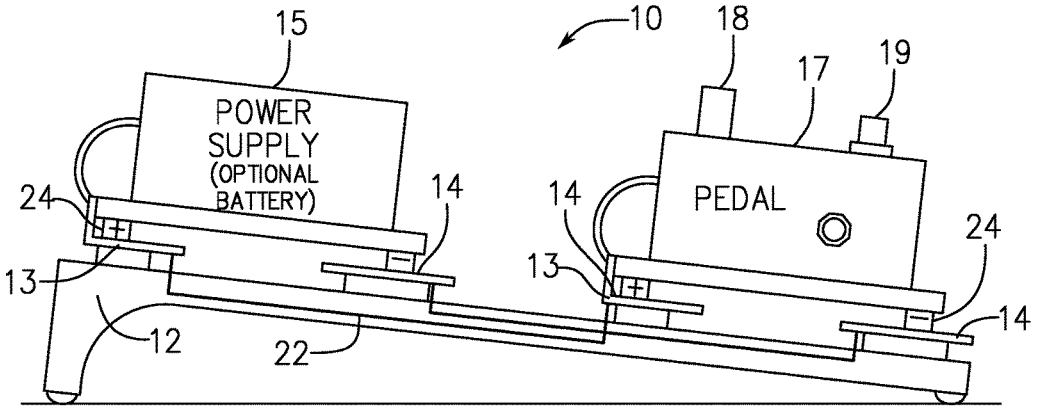
FIG. 2B depicts a side elevation view of an alternative embodiment of the magnetic pedalboard system shown in use.
Figure 3:
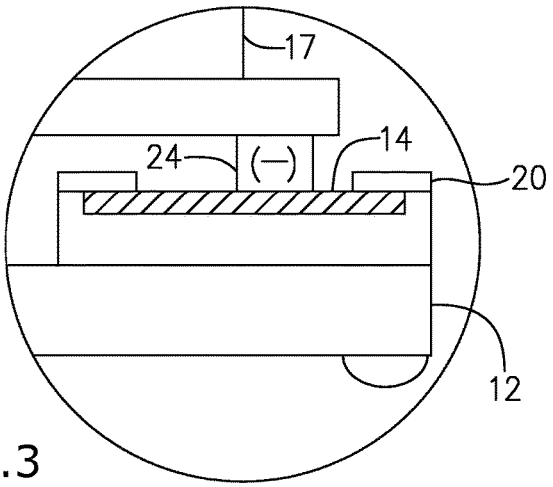
FIG. 3 depicts an elevation view of certain embodiments of the magnetic pedalboard system taken along line 3-3 in FIG. 2A.

As depicted in FIGS. 1-3, magnetic pedalboard system 10 is configured for use with a musical instrument (not shown) such as an electric guitar or bass guitar to generate sound effects associated with the instrument. However, the musical instrument can be any alternative electrical musical instrument known in the field. In certain embodiments, magnetic pedalboard system 10 generally comprises non-conductive base 12, conductive strips 14, power supply 15 and pedals 17.

In one embodiment, non-conductive base 12 is made from any generally rigid material that sufficiently supports the components of the system. In one embodiment, non-conductive base 12 comprises a generally top flat surface that is supported by any number of legs as depicted in FIG. 2. Non-conductive base 12 comprises a plurality of conductive strips 14 coupled thereon and extending along the top surface.

In one embodiment, each conductive strip 14 comprises a width of approximately 2". However, the dimensions of conductive strips 14 may vary. In certain embodiments, conductive strips 14 may be made from materials such as tin, steel, silver or any other non-corrosive electrically conductive coating or material known in the field. As depicted in FIGS. 1-2, conductive strips 14 are oriented generally parallel to each other in a preferred embodiment. Although the figures depict four conductive strips 14, it shall be appreciated that any alternative number of conductive strips 14 may be used depending on the size of non-conductive base 12 used.

In one embodiment, power supply 15 preferably is a 9-volt power supply such as a battery that is configured to provide electricity to conductive strips 14. In an alternative embodiment, power supply 15 can be connected to a power outlet. In one embodiment, power supply 15 comprises a base with at least a pair of magnetic electrical contacts 24 configured to contact a pair of conductive strips 14 on non-conductive base 12.

Figure 10:
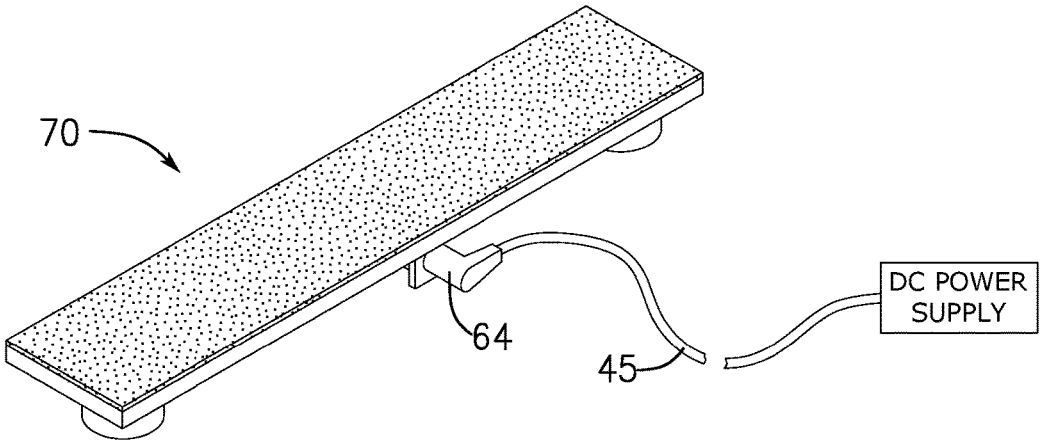
FIG. 10 depicts a top perspective view of certain embodiments of the magnetic pedalboard system illustrating a power supply.
Figure 11:
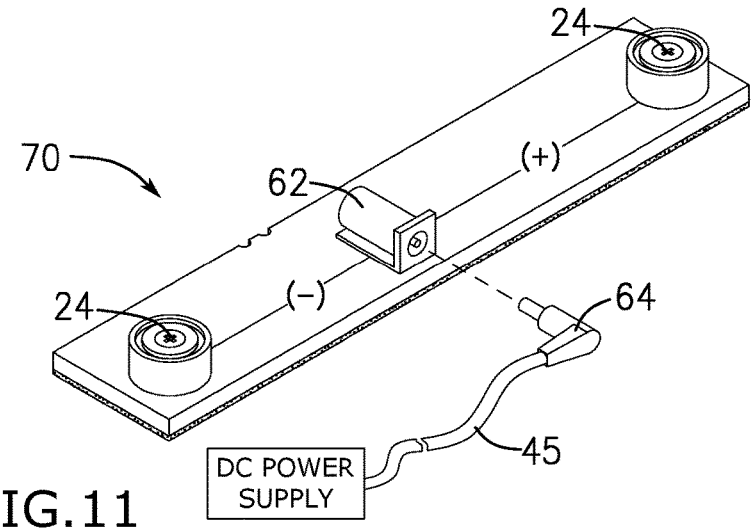
FIG. 11 depicts a bottom perspective view of certain embodiments of the magnetic pedalboard system illustrating the power supply.
Figure 12:
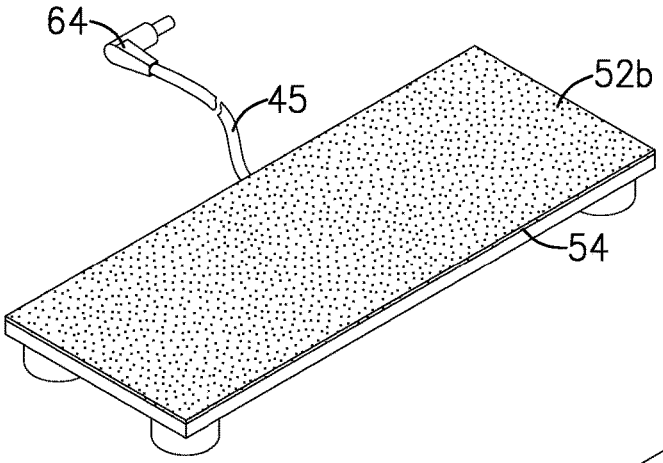
FIG. 12 depicts a top perspective view of certain embodiments of the magnetic pedalboard system illustrating the adapter base.
Figure 13:
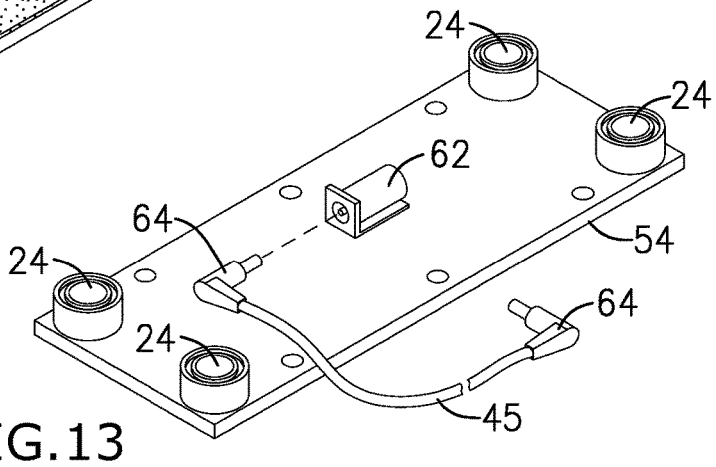
FIG. 13 depicts a bottom perspective view of certain embodiments of the magnetic pedalboard system illustrating the adapter base.
Figure 14:
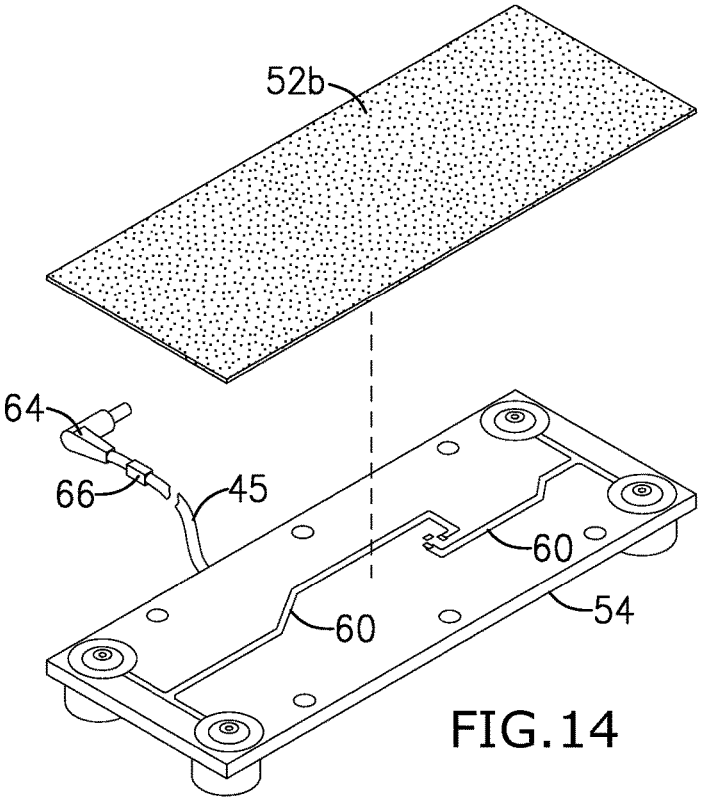
FIG. 14 depicts an exploded view of certain embodiments of the magnetic pedalboard system illustrating the adapter base.

FIGS. 10-11 depict an alternative embodiment of power supply 15, which comprises power adapter 70. Power adapter 70 comprises a pair of magnetic electrical contacts 24 electrically coupled together and configured to contact an adjacent pair of conductive strips 14 on the magnetic pedalboard system. In this embodiment, magnetic electrical contacts 24 are electrically coupled to female connector 62. In one embodiment, power input cord 45 comprises male connector 64, which engages with female connector 62 to connect a DC Power Supply to power adapter 70.

In order to electrically charge conductive strips 14, power supply 15 is disposed on a pair of conductive strips 14 as depicted in FIGS. 1-2. Each adjacent pair of conductive strips 14 is configured so that the first conductive strip 14 in the pair is positively charged with electricity and the second conductive strip 14 in the pair is negatively charged with electricity. It shall be appreciated that the pairs of conductive strips 14 can be organized in different orders across non-conductive base 12, e.g., (+) charged, (−) charged, (+) charged, (−) charged, OR (−) charged, (+) charged, (−) charged, (+) charged.

The pairs of conductive strips 14 on the magnetic pedalboard system are electrically charged so long as the first magnetic electrical contact 24 of power supply 15 is directly coupled to a first conductive strip 14 and the second magnetic electrical contact 24 of power supply 15 is directly coupled to a second adjacent conductive strip 14. This is permitted because conductive strips 14 are electrically coupled together by wiring 22, which extends within non-conductive base 12. In one embodiment, one or more illuminating devices such as LEDs are electrically coupled to wiring 22. The one or more illuminating devices activate when conductive strips 14 are electrically charged by power supply 15.

Any number of pedals 17 are operably coupled to conductive strips 14 of magnetic pedalboard system 10 and one or more musical instruments (not shown). Each pedal 17 may be any type of effects pedal known in the field. In certain embodiments, each pedal 17 comprises pedal controls 18, actuators 19, and magnetic electrical contacts 24. In a preferred embodiment, a minimum of four magnetic electrical contacts 24 are coupled to the bottom of pedal 17. However, an alternative number of magnetic electrical contacts 24 may be used instead.

In operation, any number of pedals 17 are coupled together by jumpers 16 such as patch cords, and operably connected to power supply 15 by disposing magnetic electrical contacts 24 of pedals 17 on conductive strips 14. More specifically, a first portion of magnetic electrical contacts 24 of pedal 17 is directly coupled to a first conductive strip 14 and a second portion of magnetic electrical contacts 24 of pedal 17 is directly coupled to a second conductive strip 14. The first and second portions of magnetic electrical contacts 24 of pedal 17 can slide along any adjacent pair of conductive strips 14 on the magnetic pedalboard system.

Conductive strips 14 supply electricity from power supply 15 to pedals 17 to power-up the devices. Pedals 17 can easily be rearranged to other locations of non-conductive base 12 as desired and be operational so long as magnetic electrical contacts 24 of pedals 17 remain in contact with conductive strips 14.

As depicted in FIGS. 2A and 3, a pair of retainer strips 20 are coupled to the top surface of each conductive strip 14 in one embodiment. The pair of retainer strips 20 extend along opposing side edges of conductive strip 14. Retainer strips 20 can be made from various materials and are designed to serve as a fence, which prevents power supply 15 and pedals 17 from sliding off conductive strips 14. In an alternative embodiment, one conductive strip 14 in each adjacent pair of conductive strips 14 comprises conductive L-shaped bracket 13 as depicted in FIG. 2B. Conductive L-shaped brackets 13 are designed to prevent power supply 15 and pedals 17 from sliding off the conductive strips.

Figure 4:
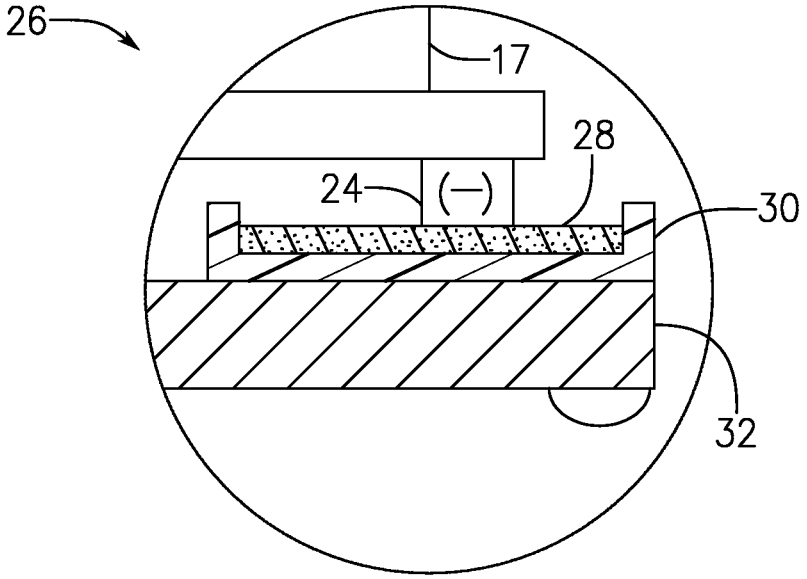
FIG. 4 depicts an elevation view of certain embodiments of the magnetic pedalboard system in an alternative configuration.

Magnetic pedalboard system 10 may have a wide variety of configurations. FIG. 4 depicts second alternative configuration 26 where magnetic pedalboard system 10 comprises metal base 32, insulator 30 and conductive paint 28. In this embodiment, pedals 17 are operably connected to power supply 15 by disposing magnetic electrical contacts 24 on conductive paint 28. Second alternative configuration 26 of magnetic pedalboard system 10 is operated in substantially the same manner as previously discussed.

Figure 5:
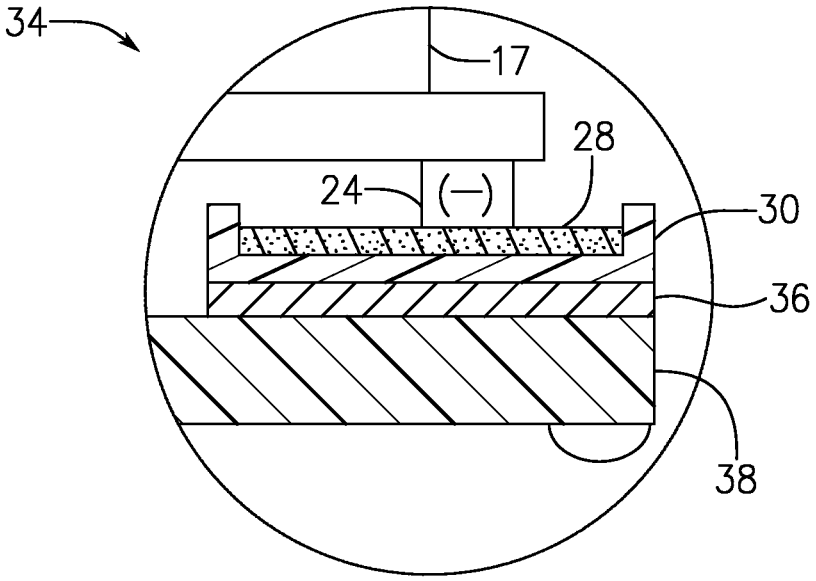
FIG. 5 depicts an elevation view of certain embodiments of the magnetic pedalboard system in an alternative configuration.

FIG. 5 depicts third alternative configuration 34 where magnetic pedalboard system 10 comprises non-conductive base 38, metal strip 36, insulator 30 and conductive paint 28.

In this embodiment, pedals 17 are operably connected to power supply 15 by disposing magnetic electrical contacts 24 on conductive paint 28. Third alternative configuration 34 of magnetic pedalboard system 10 is operated in substantially the same manner as previously discussed.

Figure 6:
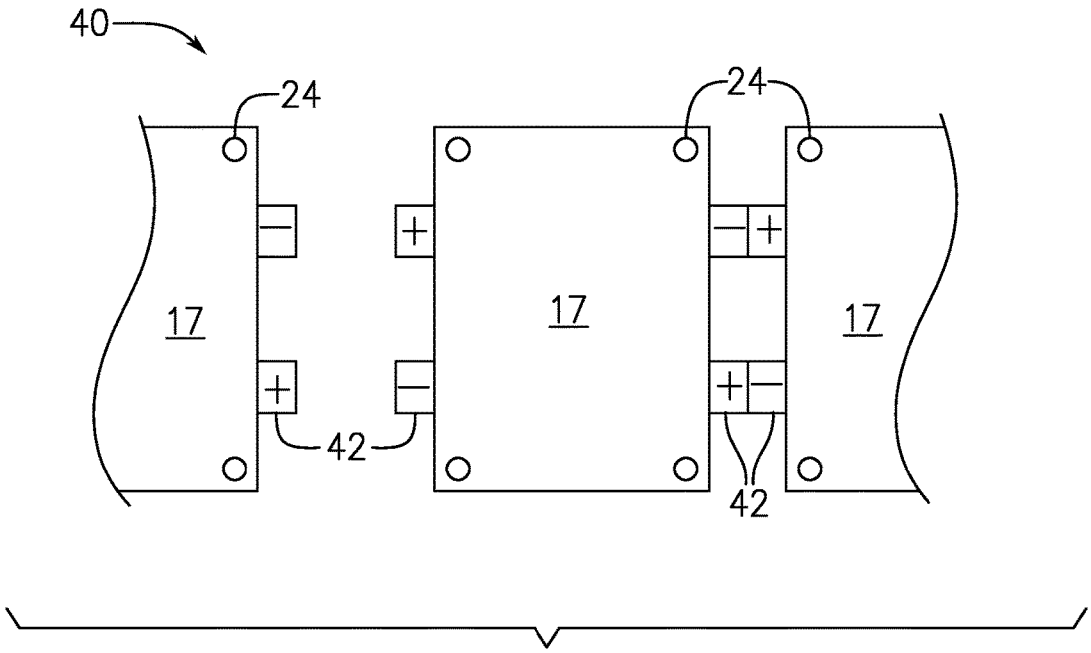
FIG. 6 depicts an exploded bottom view of certain embodiments of the magnetic pedalboard system.
Figure 7:
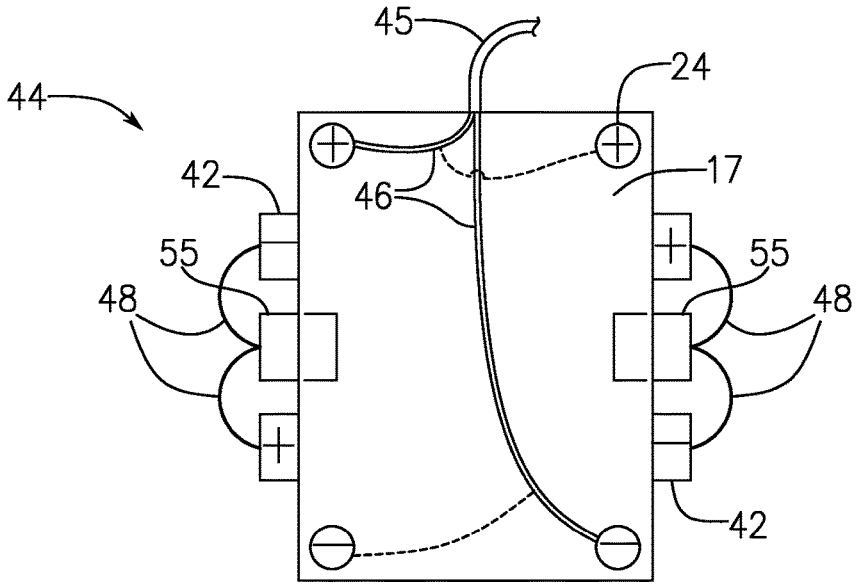
FIG. 7 depicts a bottom view of certain embodiments of the magnetic pedalboard system in an alternative configuration.

In certain embodiments, pedals 17 may be coupled together in various configurations. FIG. 6 depicts first alternative pedal assembly 40 where adjacent pedals 17 are coupled together by magnetic contacts 42. Magnetic contacts 42 transmit audio signals between adjacent pedals 17 and eliminate the need for audio patch cords. FIG. 7 depicts second alternative pedal assembly 44 where each pedal 17 comprises magnetic contacts 42 and side mount connectors 55. Adjacent pedals 17 are connected together by corresponding magnetic contacts 42 and side mount connectors 55. In one embodiment, each side mount connector 55 is a ¼" male phono plug. Wiring 48 connects corresponding positive and negative magnetic contacts 42 on each side of pedal 17. In one embodiment, each pedal 17 in second alternative pedal assembly 44 comprises power input cord 45 coupled to magnetic contacts 24 by external power source wiring 46. Magnetic contacts 42, wiring 48 and side mount connectors 55 allow the guitar sound to be transmitted from one pedal to the next pedal.

Figure 8:
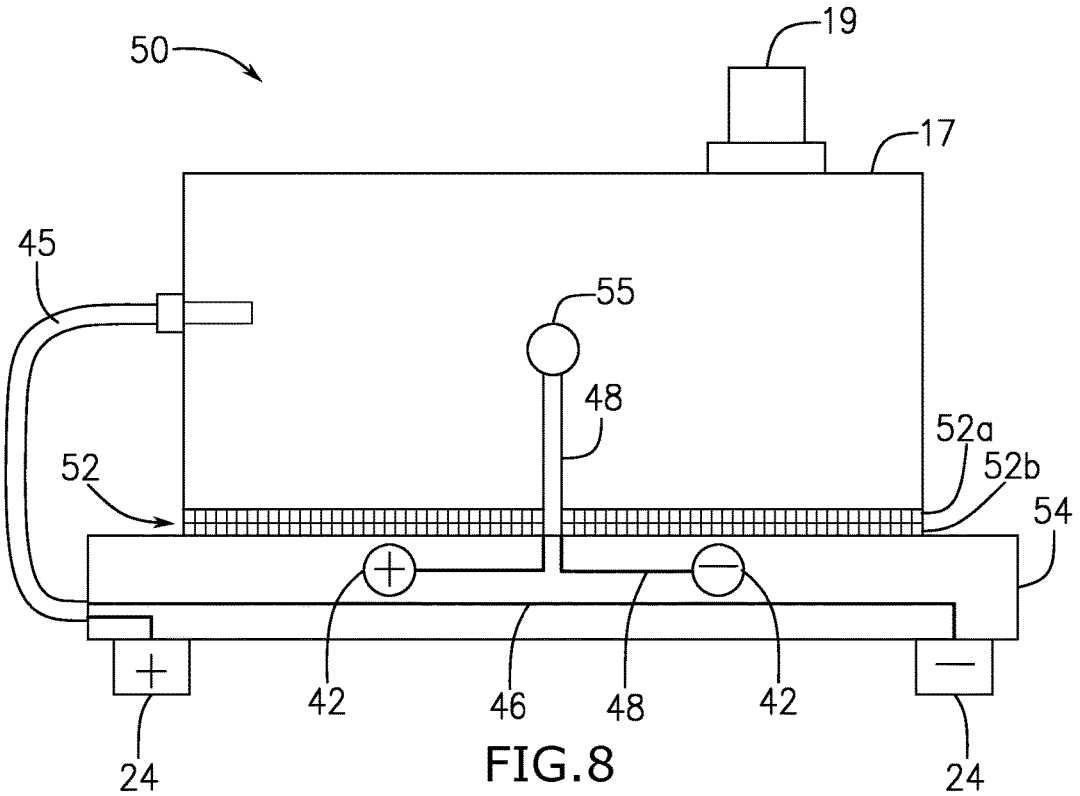
FIG. 8 depicts a side elevation view of certain embodiments of the magnetic pedalboard system illustrating a pedal mounted to an adapter base.
Figure 9:
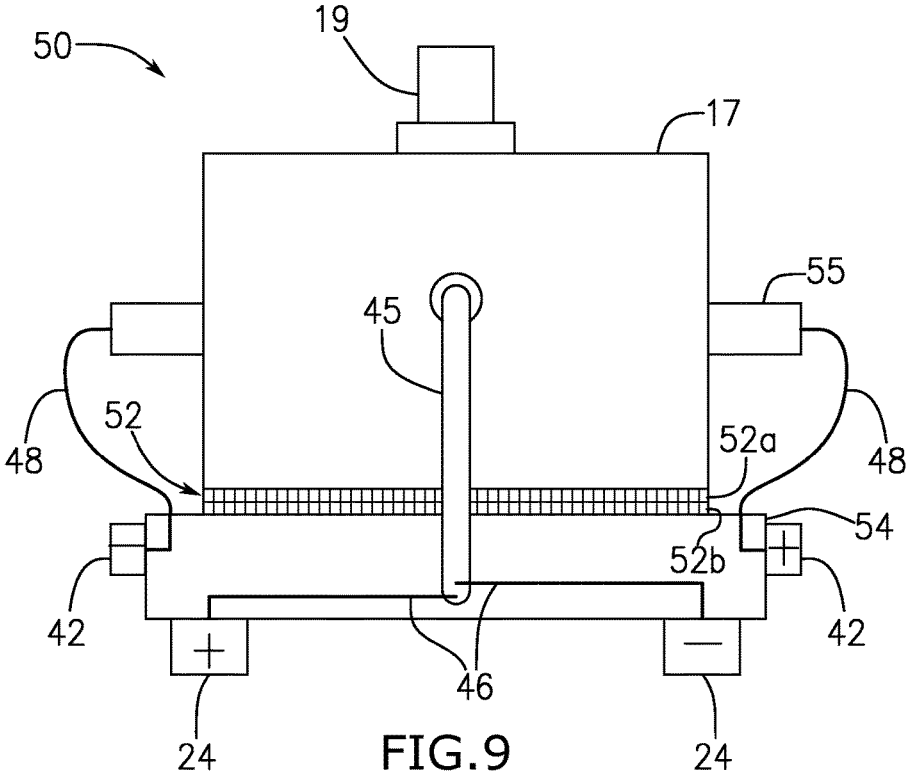
FIG. 9 depicts a front elevation view of certain embodiments of the magnetic pedalboard system illustrating the pedal mounted to the adapter base.

FIGS. 8-9 depict third alternative pedal assembly 50 where each pedal 17 is coupled to adapter base 54 by hook and loop fasteners 52. Hook fasteners 52*a* are configured to engage with loop fasteners 52*b*. In an alternative embodiment, the location of hook and look fasteners 52*a*, 52*b* can be interchanged on pedal 17 and adapter base 54. It shall be appreciated that alternative fasteners such as snap components or other fastening members can be used to attach pedal 17 to adapter base 54.

As depicted in FIGS. 8-9 and 12-14, two pairs of magnetic electrical contacts 24 are coupled to the bottom surface of adapter base 54. The pairs of magnetic electrical contacts 24 are electrically coupled together by wiring 60. Wiring 60 is electrically coupled to female connector 62. In one embodiment, power input cord 45 comprises a pair of male connectors 64 on opposing ends. Power input cord 45 is configured to electrically couple adapter base 54 and pedal 17 together. This is accomplished by coupling the first male connector 64 of power input cord 45 to female connector 62 of adapter base 54 and the second male connector 64 of power input cord 45 with pedal 17.

In operation, third alternative pedal assembly 50 is maneuvered so that magnetic electrical contacts 24 of adapter base 54 contact conductive strips 14. More specifically, a first pair of magnetic electrical contacts 24 of adapter base 54 is directly coupled to a first conductive strip 14 and a second pair of magnetic electrical contacts 24 of adapter base 54 is directly coupled to a second conductive strip 14.

Magnetic electrical contacts 24 of adapter base 54 can slide along any adjacent pair of conductive strips 14 on the magnetic pedalboard system. This permits electricity from power supply 15 to travel through conductive strips 14, magnetic electrical contacts 24 of adapter base 54 and power input cord 45 to enable each pedal 17. Pedal 17 is operational so long as magnetic electrical contacts 24 of adapter base 54 remain in contact with conductive strips 14.

In one embodiment, voltage converter 66 is electrically coupled to magnetic contacts 24 of adapter base 54 and pedal 17. Voltage converter 66 is a Step-Up or Step-Down converter that adjusts the voltage at pedal 17 to be 9V, 12V, 18V or 24 V.

It shall be appreciated that the components of magnetic pedalboard system 10 described in several embodiments herein may comprise any alternative known materials in the field and be of any color, size and/or dimensions. It shall be appreciated that the components of magnetic pedalboard system 10 described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A magnetic pedalboard system configured to supply power to a plurality of effects pedals for use in conjunction with a musical instrument to generate sound effects, the magnetic pedalboard system comprising:

a base member comprising a top surface and a bottom surface;

a pair of conductive strips coupled to the top surface of the base member and electrically coupled to a power supply, the first conductive strip in the pair of conductive strips being positively charged and the second conductive strip in the pair of conductive strips being negatively charged; and at least one pedal coupled to the pair of conductive strips, the at least one pedal comprising a plurality of magnetic electrical contacts, the plurality of magnetic electrical contacts comprising a first portion of magnetic electrical contacts electrically coupled to a second portion of magnetic electrical contacts;

wherein the at least one pedal is configured to slide along any portion of the pair of conductive strips with the first portion of magnetic electrical contacts directly coupled to the first conductive strip and the second portion of magnetic electrical contacts directly coupled to the second conductive strip, thereby permitting the power supply to transmit electricity through the pair of conductive strips to the at least one pedal.

2. The magnetic pedalboard system of claim 1, wherein the power supply comprises a power adapter electrically coupled to a power outlet or a battery, the power adapter comprising a pair of magnetic electrical contacts, the first magnetic electrical contact in the pair of magnetic electrical contacts of the power adapter directly coupled to the first conductive strip and the second magnetic electrical contact in the pair of magnetic electrical contacts of the power adapter directly coupled to the second conductive strip.

3. The magnetic pedalboard system of claim 2, further comprising a pair of retainer strips coupled to each conductive strip in the pair of conductive strips, the pair of retainer strips extending along opposing side edges of the conductive strip.

4. The magnetic pedalboard system of claim 2, wherein one of the pair of conductive strips comprises a L-shaped bracket.

5. A magnetic pedalboard system configured to supply power to a plurality of effects pedals for use in conjunction with a musical instrument to generate sound effects, the magnetic pedalboard system comprising:

a base member comprising a top surface and a bottom surface;

a pair of conductive strips coupled to the top surface of the base member and electrically coupled to a power supply, the first conductive strip in the pair of conductive strips being positively charged and the second conductive strip in the pair of conductive strips being negatively charged;

an adapter base coupled to the pair of conductive strips and comprising a plurality of magnetic electrical contacts, the plurality of magnetic electrical contacts comprising a first portion of magnetic electrical contacts electrically coupled to a second portion of magnetic electrical contacts; and at least one pedal coupled to the adapter base and electrically coupled to the plurality of magnetic electrical contacts of the adapter base;

wherein the adapter base is configured to slide along any portion of the pair of conductive strips with the first portion of magnetic electrical contacts directly coupled to the first conductive strip and the second portion of magnetic electrical contacts directly coupled to the second conductive strip, thereby permitting the power supply to transmit electricity through the pair of conductive strips and adapter base to the at least one pedal.

6. The magnetic pedalboard system of claim 5, wherein the adapter base comprises a top surface and a bottom surface, the top surface of the adapter base detachably coupled to the at least one pedal and the bottom surface of the adapter base comprising the plurality of magnetic electrical contacts coupled thereto.

7. The magnetic pedalboard system of claim 6, wherein the power supply comprises a power adapter electrically coupled to a power outlet or a battery, the power adapter comprising a pair of magnetic electrical contacts, the first magnetic electrical contact in the pair of magnetic electrical contacts of the power adapter directly coupled to the first conductive strip and the second magnetic electrical contact in the pair of magnetic electrical contacts of the power adapter directly coupled to the second conductive strip.

8. The magnetic pedalboard system of claim 7, further comprising a voltage converter electrically coupled to the magnetic contacts of the adapter base and the at least one pedal.

9. The magnetic pedalboard system of claim 8, further comprising a pair of retainer strips coupled to each conductive strip in the pair of conductive strips, the pair of retainer strips extending along opposing side edges of the conductive strip.

10. The magnetic pedalboard system of claim 8, wherein one of the pair of conductive strips comprises a L-shaped bracket.

* * * * *